US007101329B2

(12) United States Patent
Johnston

(10) Patent No.: US 7,101,329 B2
(45) Date of Patent: Sep. 5, 2006

(54) VARIABLE EXERCISE APPARATUS

(76) Inventor: Gary Lawrence Johnston, P.O. Box 183, Cowarts, AL (US) 36321

( * ) Notice: Subject to any disclaimer, the term of this patent is extended or adjusted under 35 U.S.C. 154(b) by 144 days.

(21) Appl. No.: 10/229,404

(22) Filed: Aug. 28, 2002

(65) Prior Publication Data

US 2004/0043880 A1 Mar. 4, 2004

(51) Int. Cl.
*A63B 71/00* (2006.01)

(52) U.S. Cl. ..... 482/148; D21/663; 601/49

(58) Field of Classification Search ..... 482/148, 482/101; D21/432, 435, 424, 663, 689, 423; 472/1, 88, 114; 144/8; 280/87.01, 647; D06/334; 297/259.1, 258; 446/482; 601/49
See application file for complete search history.

(56) References Cited

U.S. PATENT DOCUMENTS 4,422,658 A * 12/1983 Hilliard ..... 280/47.4
2003/0039113 A1* 2/2003 Murr et al. ..... 362/31
2004/0152572 A1* 8/2004 Reitz et al. ..... 482/140

* cited by examiner

*Primary Examiner*—Lori Amerson

(57) ABSTRACT

A variable exercise apparatus comprises a frame structure member a user support member having a seat, and a user engagement member. The back end of the user engagement member is pivotally mounted to the frame structure member. An engagement assembly is mounted to the front end of the user engagement member via an assembly support capable of moving in the upward and downward directions. The lower end of the assembly support is connected by a wheel member to a guide member, which is mounted on the frame structure member. The user sits in the seat and pushes against the engagement assembly, with the general thigh portion of the leg, in either the downward, upward, and/or side directions. The wheel member will follow the contour of the guide member.

7 Claims, 13 Drawing Sheets

VARIABLE EXERCISE APPARATUS

BACKGROUND OF THE INVENTION

This invention relates to a variable exercise apparatus which has an upright structure that allows the user to perform pivoting exercise routines while in a seated position. This feature allows for a better lower body workout than provided by more conventional lower body exercise devices.

SUMMARY AND OBJECTS OF THE INVENTION

It is the object of this invention to provide an exercise apparatus which may provide the user a well balanced lower body exercise routine. The main purpose of this application is to demonstrate an apparatus which performs the stated function, and to demonstrate the many options and configurations the apparatus may take on.

Briefly stated, the apparatus that forms the basis of the present invention comprises a frame structure means, a user support means, and a user engagement means. The user support means and the user engagement means are mounted upon the frame structure means. Optional items include a back support member and handle members associated with the user support means. Also, an optional resistance means may be supported by the frame means and operatively connect to the user engagement means. A motor means may also be an optional item supported by the frame structure means and used to produce an automatic pivoting motion in the user engagement means.

The design of the apparatus is such that the user engagement means is moveable in a pivoting pattern about the frame structure means. An assembly support member, which is part of the user engagement means is free to move in the upward and downward directions. The lower portion of the assembly support member follows the contour of a guide member, which is mounted on the frame structure means. Therefore as the assembly support member moves in an upward or downward direction, as determined by the varying contour of the guide member, the user engagement means pivots about the frame structure means.

Other objects, features, and advantages for this invention will be apparent from the following detailed description and the appended claims, references being made to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
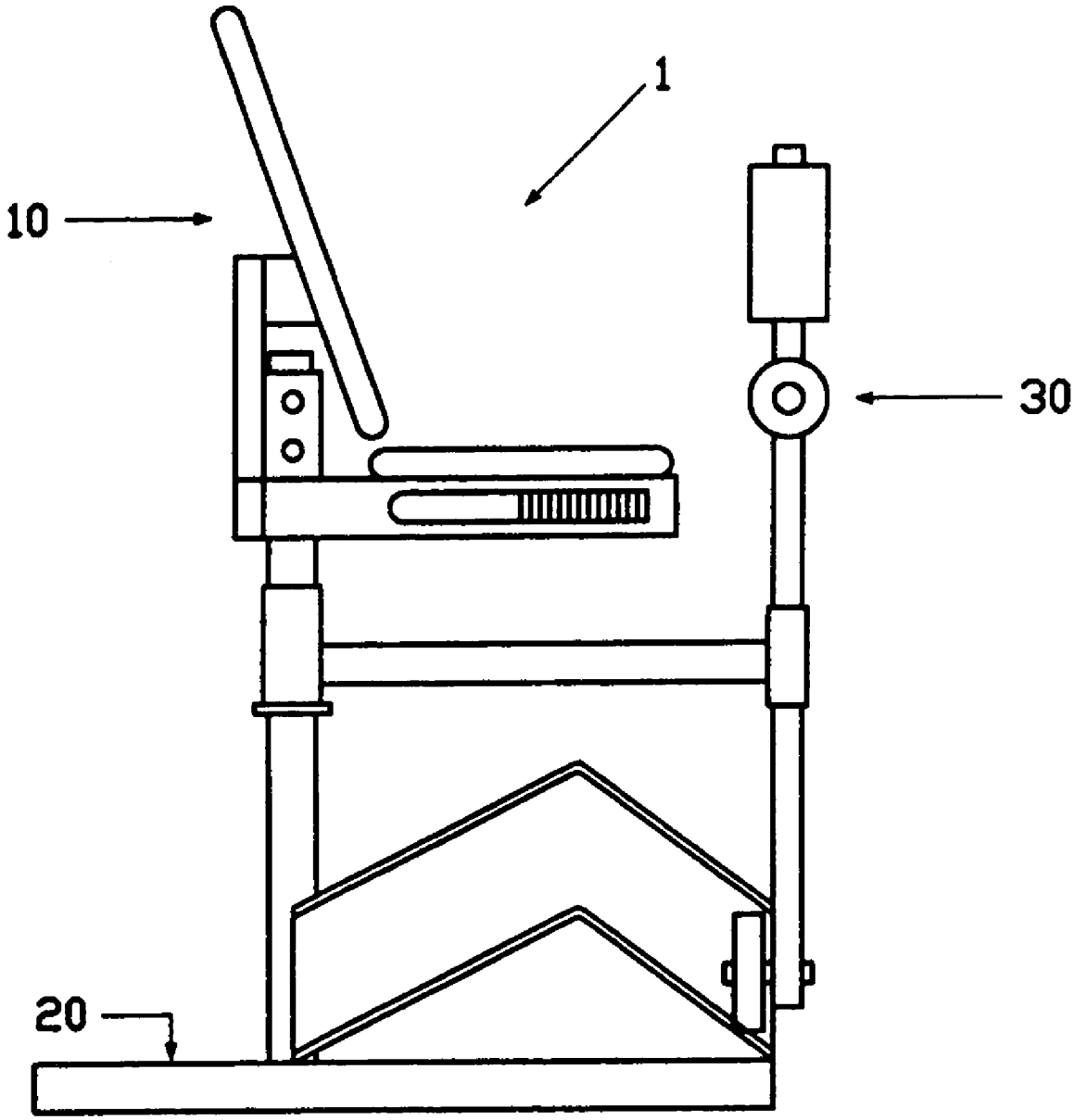
FIG. 1A is a side view of the variable exercise apparatus.
Figure 1B:
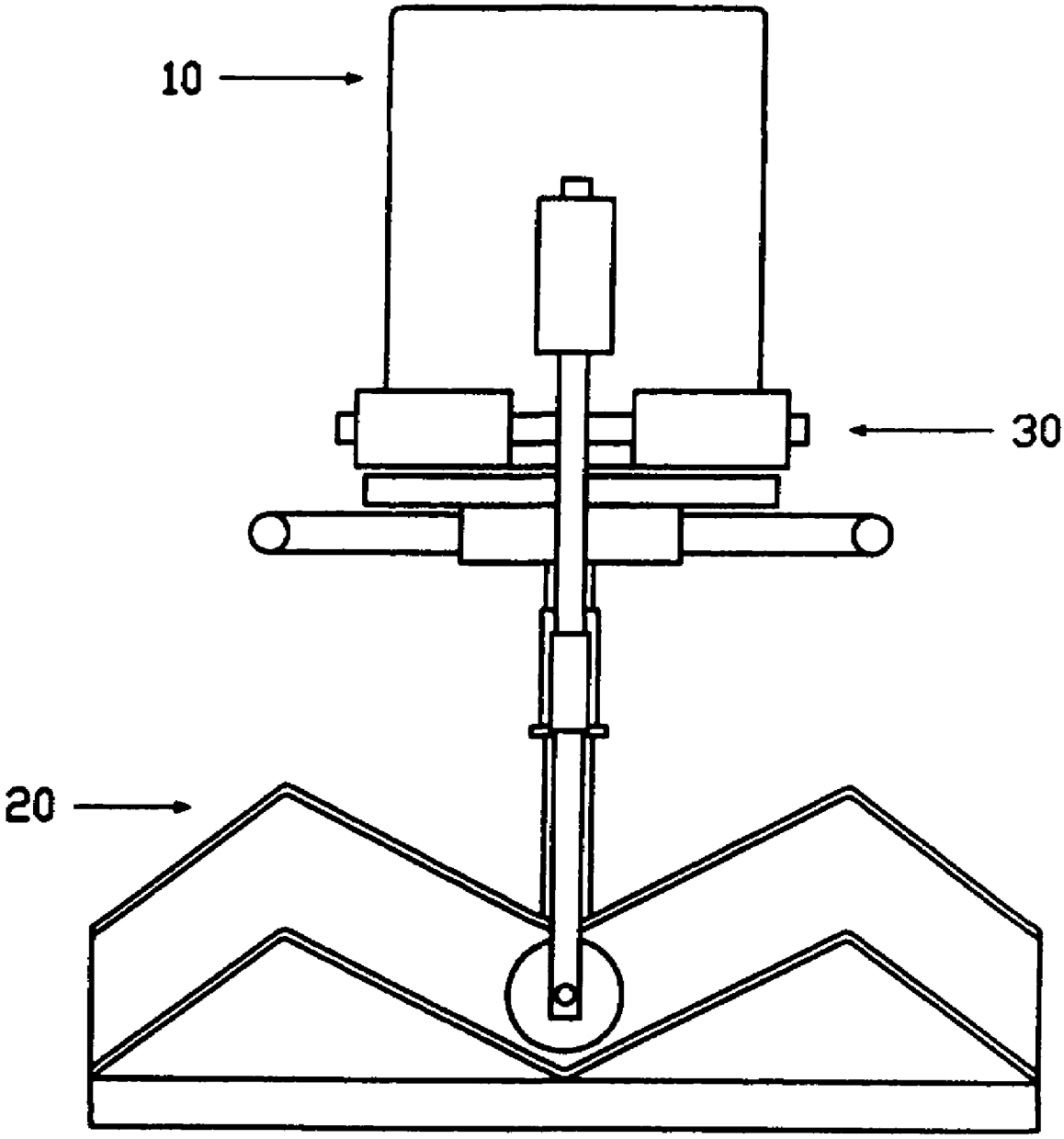
FIG. 1B is a front view of the variable exercise apparatus.
Figure 1C:
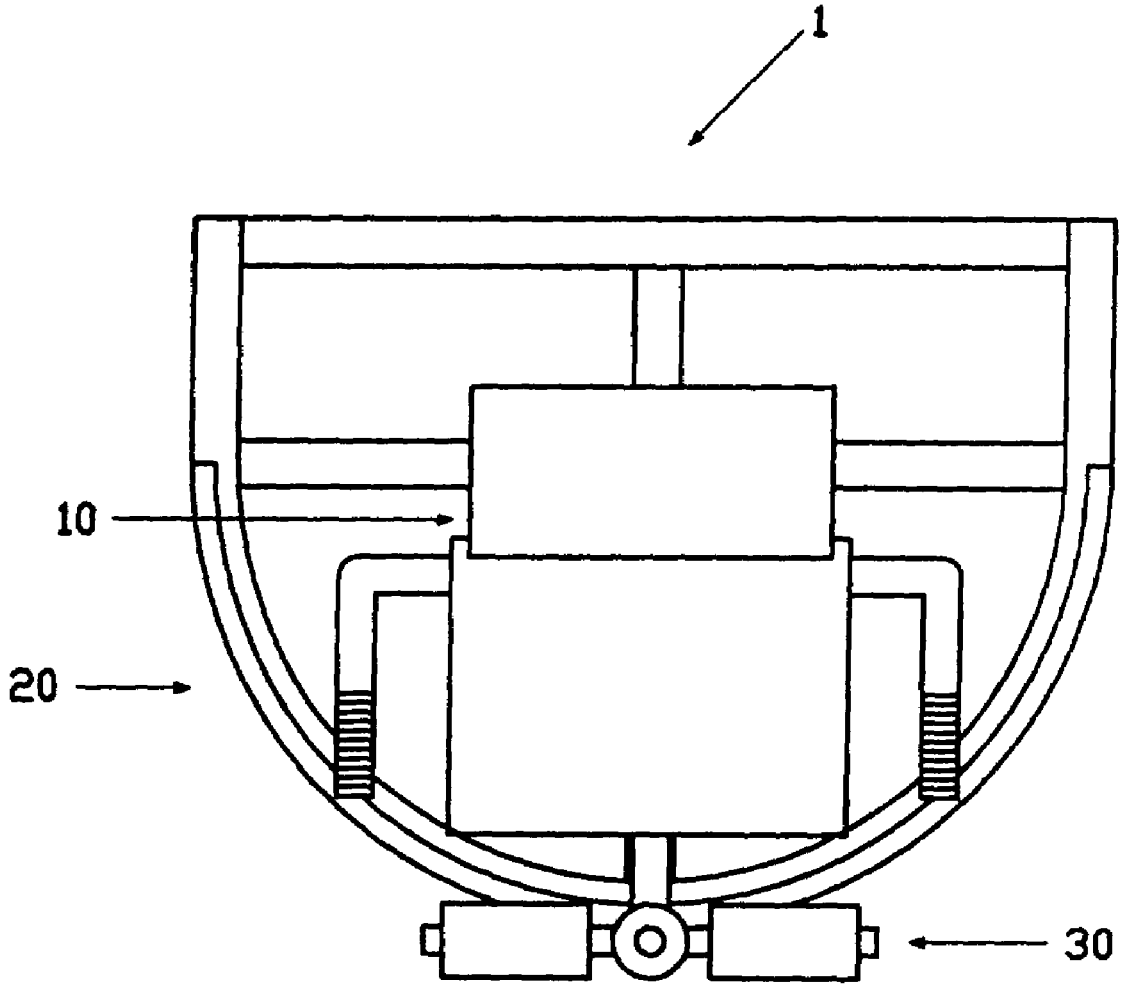
FIG. 1C is a top view of the variable exercise apparatus.

As best can be seen by references to the drawings, and in particular to FIGS. 1A–1C, the variable exercise apparatus that forms the basis of the present invention is designated generally by the reference numeral 1, and includes a frame structure means 10, a user support means 20, and a user engagement means 30. The user support means 20 and the user engagement means are mounted on frame structure means 10.

Figure 2A:
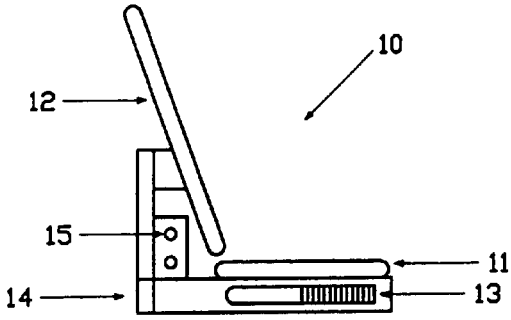
FIG. 2A is a side view of the frame structure means of the variable exercise apparatus.
Figure 2B:
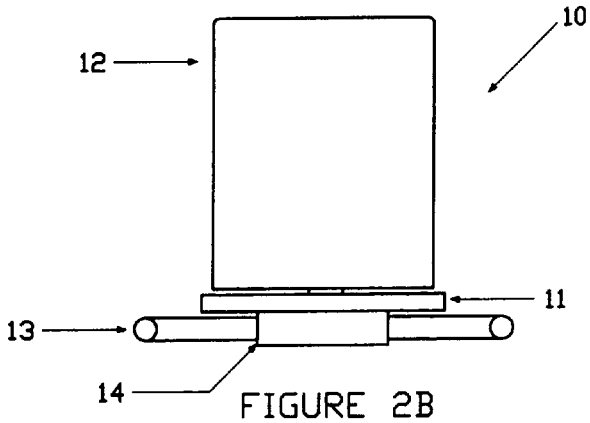
FIG. 2B is a front view of the frame structure means of the variable exercise apparatus.
Figure 2C:
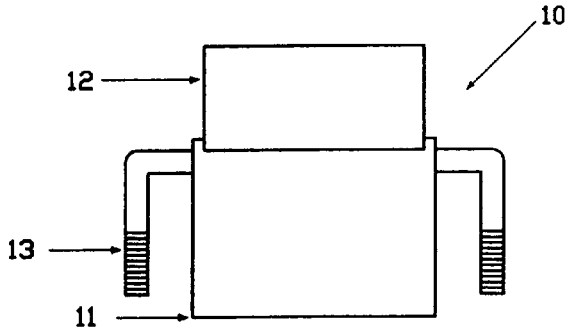
FIG. 2C is a top view of the frame structure means of the variable exercise apparatus.

As may be seen in FIGS. 2A–2C, the user support means 10 comprises a seat member 11 mounted on user support structure 14. Optional back support member 12 and optional handle members 13 may also mount to user support structure 14. The device is normally operated by the user while in a seated position.

Figure 3A:
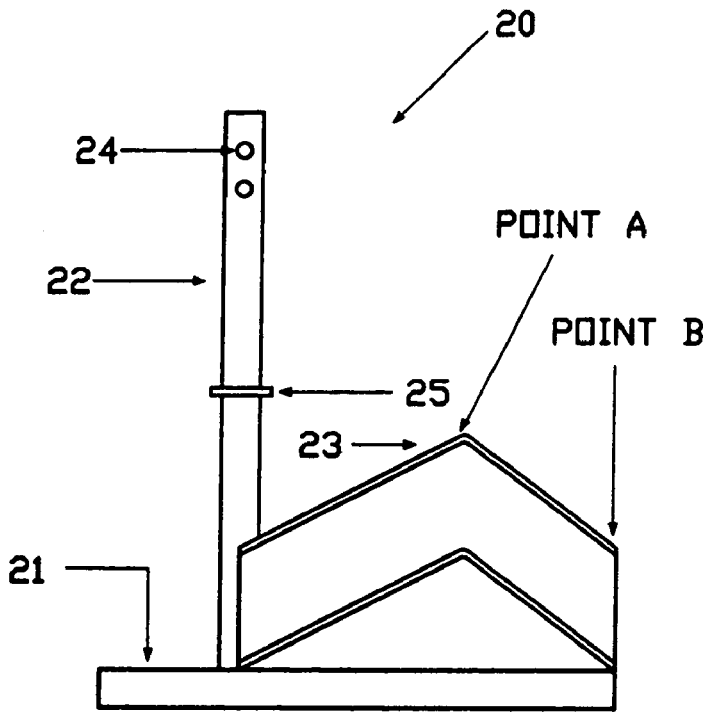
FIG. 3A is a side view of the user support means of the variable exercise apparatus.
Figure 3B:
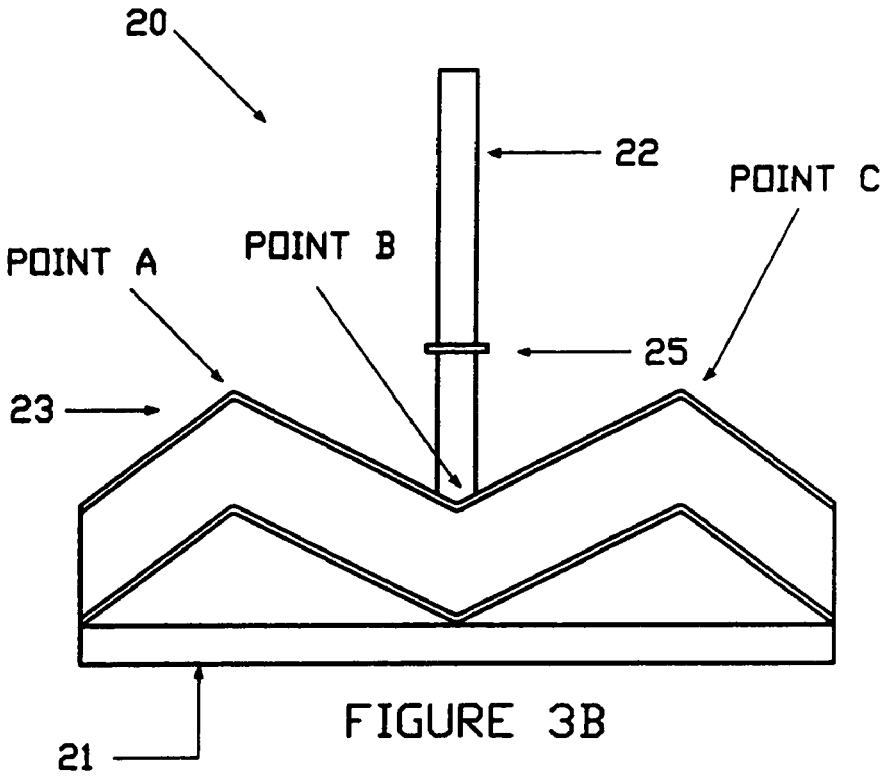
FIG. 3B is a front view of the user support means of the variable exercise apparatus.
Figure 3C:
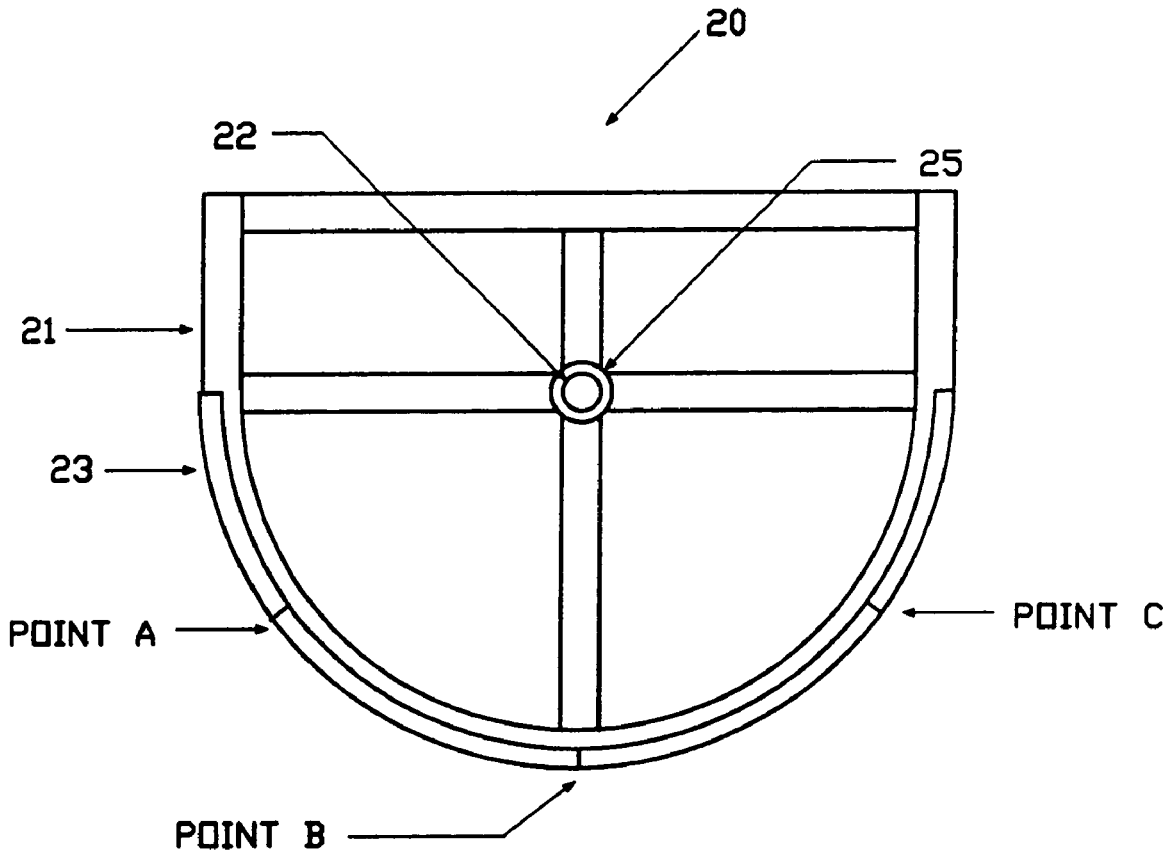
FIG. 3C is a top view of the user support means of the variable exercise apparatus.

As may also be seen in FIGS. 3A–3C, the frame structure means 20 comprises a base 21, a support member 22 having openings 24, a stop component 25, and a guide member 23. The seat support structure 14 of seat means 10 mounts to the support member 22 through openings 24 and openings 15 via a bolt or pin.

Figure 4A:
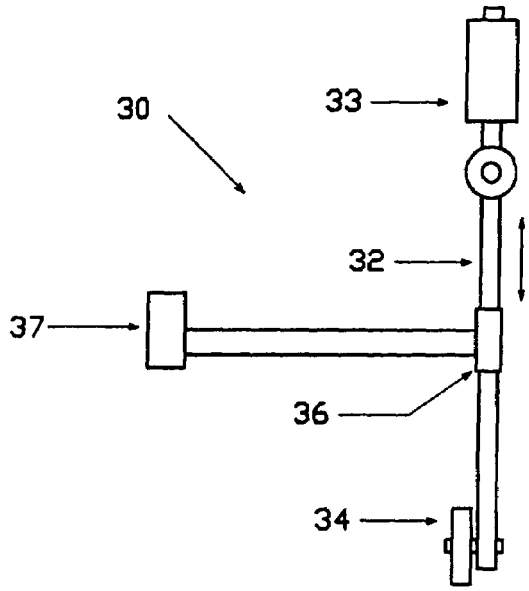
FIG. 4A is a side view of the user engagement means of the variable exercise apparatus.
Figure 4B:
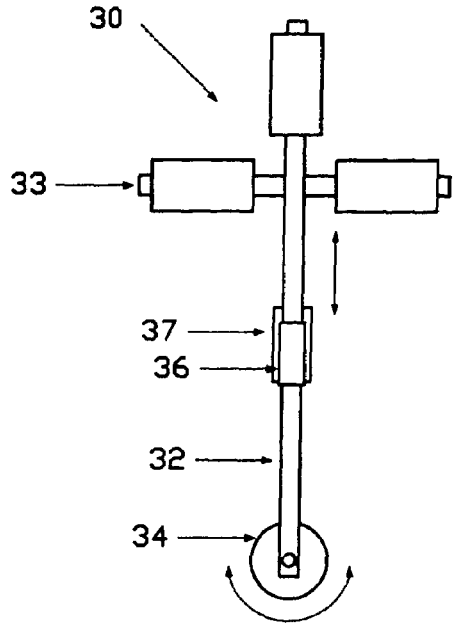
FIG. 4B is a front view of the user engagement means of the variable exercise apparatus.
Figure 4C:
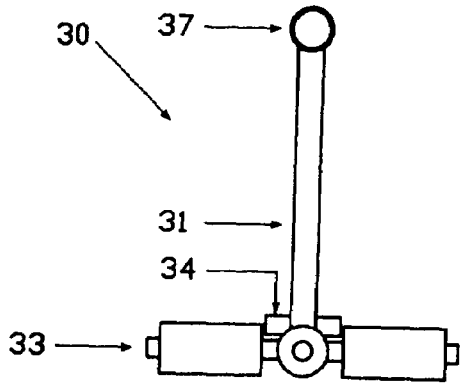
FIG. 4C is a top view of the user engagement means of the variable exercise apparatus.

As may be seen in FIGS. 4A–4C, the user engagement means 30 is comprised of engagement assembly 33 mounted to the upper part of assembly support member 32. Assembly support member 32 is mounted to guide element 36 of engagement support structure 31. Assembly guide element 36 guides assembly support member 32 in the upward and downward directions. Engagement support structure 31 also has coupling member 37, which pivots the user engagement means 30 about the support member 22 of frame structure means 20. This allows engagement support structure 31 to rotate about support member 37. The stop component 25 of frame structure means 20 keeps engagement support structure 31 from moving down along support member 22. At the bottom of assembly support member 22 is wheel member 34, which is used to connect assembly support member 32 with the guide member 23 of frame structure means 20. There are many ways to couple the assembly support member to the frame structure member, with the demonstrated wheel member coupled to the guide member being just one. Other ways include grooved rollers mounted on the end of the assembly support and rolling along a curved round bar mounted on the frame. Another is a type of bearing mounted on the end of the assembly support and coupled to a curved guide rail mounted on the frame. There are several other commonly known ways to do this, but the wheel member and guide member shown are probably the easiest, but are meant only as demonstration.

Figure 4D:
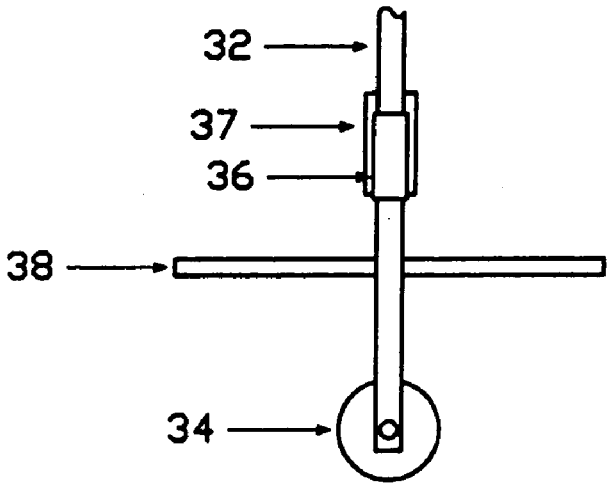
FIG. 4D is a side view of the user engagement means of the variable exercise apparatus showing an optional foot support member.
Figure 4E:
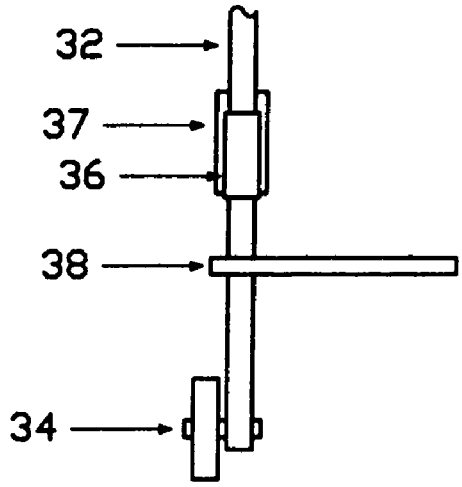
FIG. 4E is a front view of the user engagement means of the variable exercise apparatus showing an optional foot support member.
Figure 4F:
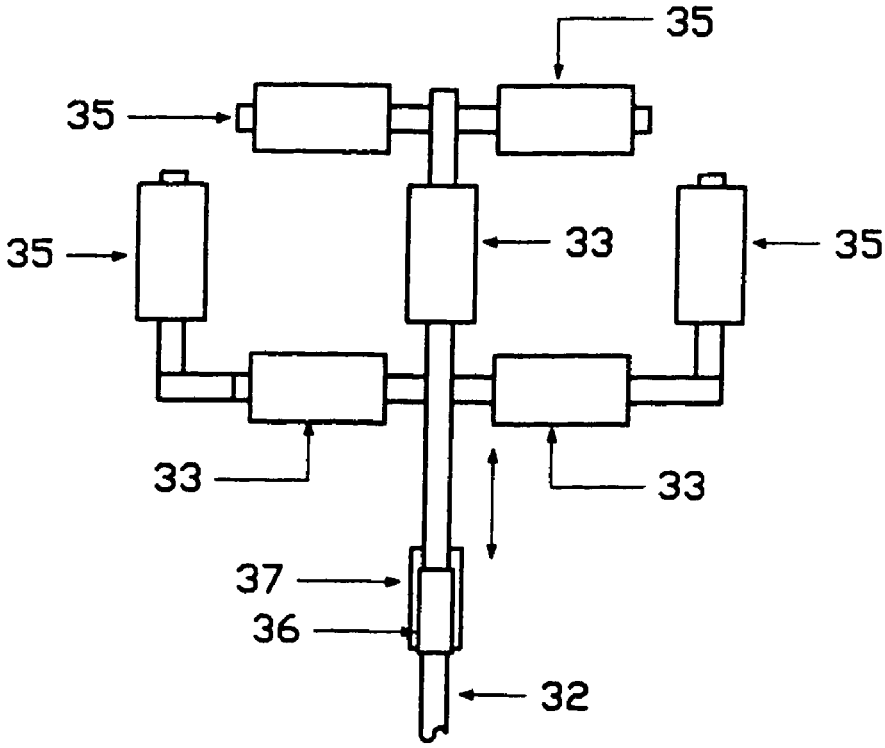
FIG. 4F is a front view of the user engagement means of the variable exercise apparatus demonstrating additional engagement members.

FIGS. 4D and 4E demonstrate an optional foot support member 38 which may mount upon assembly support member 32. The user may engage the foot support member with their feet, pushing downward, which may also create pivoting motion in the user engagement means 30. Or, the user may use the foot support member 38 just to rest their feet while engaging the engagement members with the general thigh portion of the legs. FIG. 4F demonstrates additional engagement members 35, which add versatility to the device.

Figure 4G:
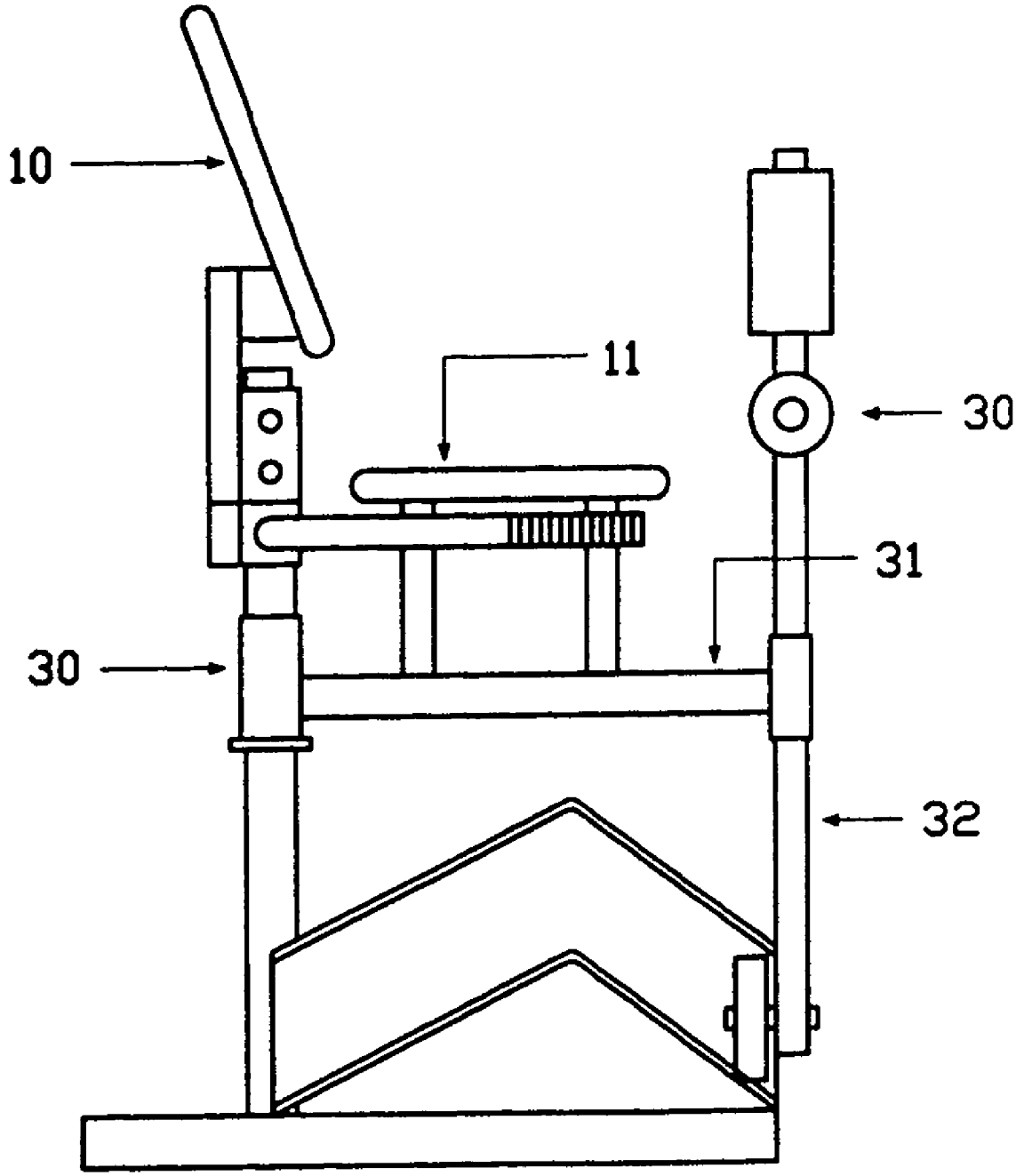
FIG. 4G is a side view of the user engagement means of the variable exercise apparatus with the seat mounted to the user engagement means so that it pivots in conjunction with the user engagement means.

It would also be possible to mount the seat to the engagement support member as shown in FIG. 4G. In this instance, the seat would pivot with the engagement support member.

FIGS. 5A–5D demonstrates how movement of the wheel member 34 of user engagement means 30 along the guide member 23 causes upward and downward movement of assembly support member 32, and vice versa. As may be seen in these and some of the other figures, rotation of user engagement means 30 about support member 22 may be accomplished in different ways. The most obvious way is by pushing against engagement assembly 33 and/or 35 in a generally horizontal direction. Another way is by pushing against the engagement assembly 33 and/or 35 in a generally vertical direction, while the wheel member 34 is in contact with the guide member 23 at an inclined contour. The guide member 23 may have different contours, "U" or "V" shaped, flat, inverted "U" or "V" shaped, etc., which may be used to produce different pivoting movement of the user engagement means and/or different upward and downward movement of the assembly support member. This movement occurs as wheel member 34 moves along the contour of the guide member 23. The user may push in both the general horizontal and general vertical directions at the same time.

Figure 5A:
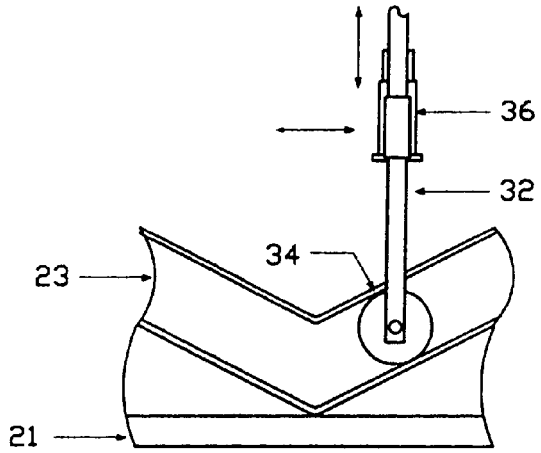
FIG. 5A is a side view of the variable exercise apparatus demonstrating one type of contour of the frame structure means, also showing how the contour moves the an engagement assembly in the upward and downward directions as the user engagement means rotates about the frame structure means.

As shown in FIG. 5A, when the user pushes against the engagement assembly in a downward direction, while the wheel member 34 is in the shown position, the assembly support member 32 will move downward, and the wheel member 34 will traverse down the incline. This causes the user engagement means to pivot towards the left. When the user pushes against the engagement assembly in the upward direction, the assembly support member will move upward, and the wheel member will traverse up the incline. This causes the user engagement means to pivot towards the right. Alternately, if the user pushes against the engagement assembly in the right side direction, the user engagement means will pivot towards the right, which will cause the assembly support member 32 to move upward. If the user pushes against the user engaging assembly in the left side direction, the user engagement means will pivot towards the left, which will cause the assembly support member 32 to move downward.

Figure 5B:
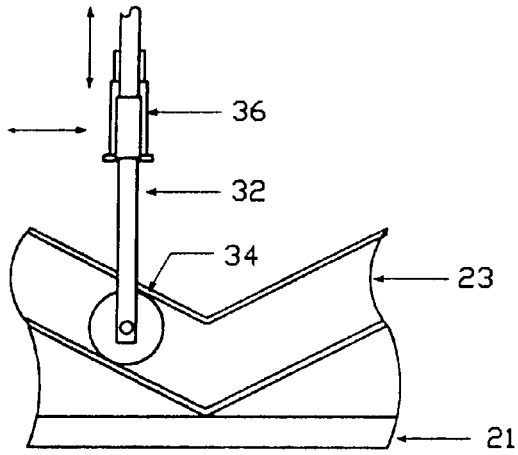
FIG. 5B is a side view of the variable exercise apparatus demonstrating a second type of contour of the frame structure means, also showing how the contour moves an engagement assembly in the upward and downward directions as the user engagement means rotates about the frame structure means.

FIG. 5B demonstrates a motion different from that of FIG. 5A. When the user pushes against the engagement assembly in a downward direction, while the wheel member 34 is in the shown position, the assembly support member 32 will move downward, and the wheel member 34 will traverse down the incline. This causes the user engagement means to pivot towards the right. When the user pushes against the engagement assembly in the upward direction, the assembly support member will move upward, and the wheel member will traverse up the incline. This causes the user engagement means to pivot towards the left. Alternately, if the user pushes against the engagement assembly in the right side direction, the user engagement means will pivot towards the right, which will cause the assembly support member 32 to move downward. If the user pushes against the user engaging assembly in the left side direction, the user engagement means will pivot towards the left, which will cause the assembly support member 32 to move upward.

Figure 5C:
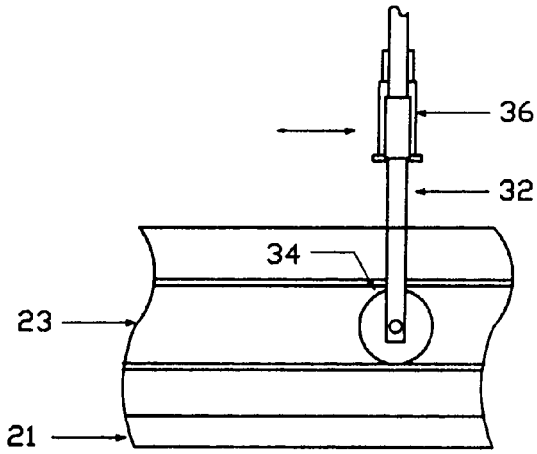
FIG. 5C is a side view of the variable exercise apparatus demonstrating a third type of contour of the frame structure means, also showing how the contour moves an engagement assembly in the upward and downward directions as the user engagement means rotates about the frame structure means.

FIG. 5C demonstrates a section of the guide member in which the contour is relatively flat. In this instance, the wheel member 34 is constrained so that assembly support member 32 cannot move in the upward and downward directions. Therefore the user may push against the engagement assembly only in the right and left side directions to produce the respective pivoting movement of the user engagement means.

As mentioned previously, varying contours in the guide means will produce varying motion in the assembly support member and the user engagement means. A section of the guide member may have a contour with an inverted "U" or "V" shape, as may be seen in FIGS. 1A and 1B. The movement of the assembly support member and the user engagement means would be somewhat opposite of the movement generated by the upright "U" or "V" shaped interval shown in FIGS. 5A and 5B. There are many other interval contours which may be developed, including a combination of those described, which are mostly for demonstration purposes. The ability to have different contours greatly enhances the potential of the apparatus. The wheel assembly may also have a protective covering to prohibit object from interfering with its motion.

Figure 6:
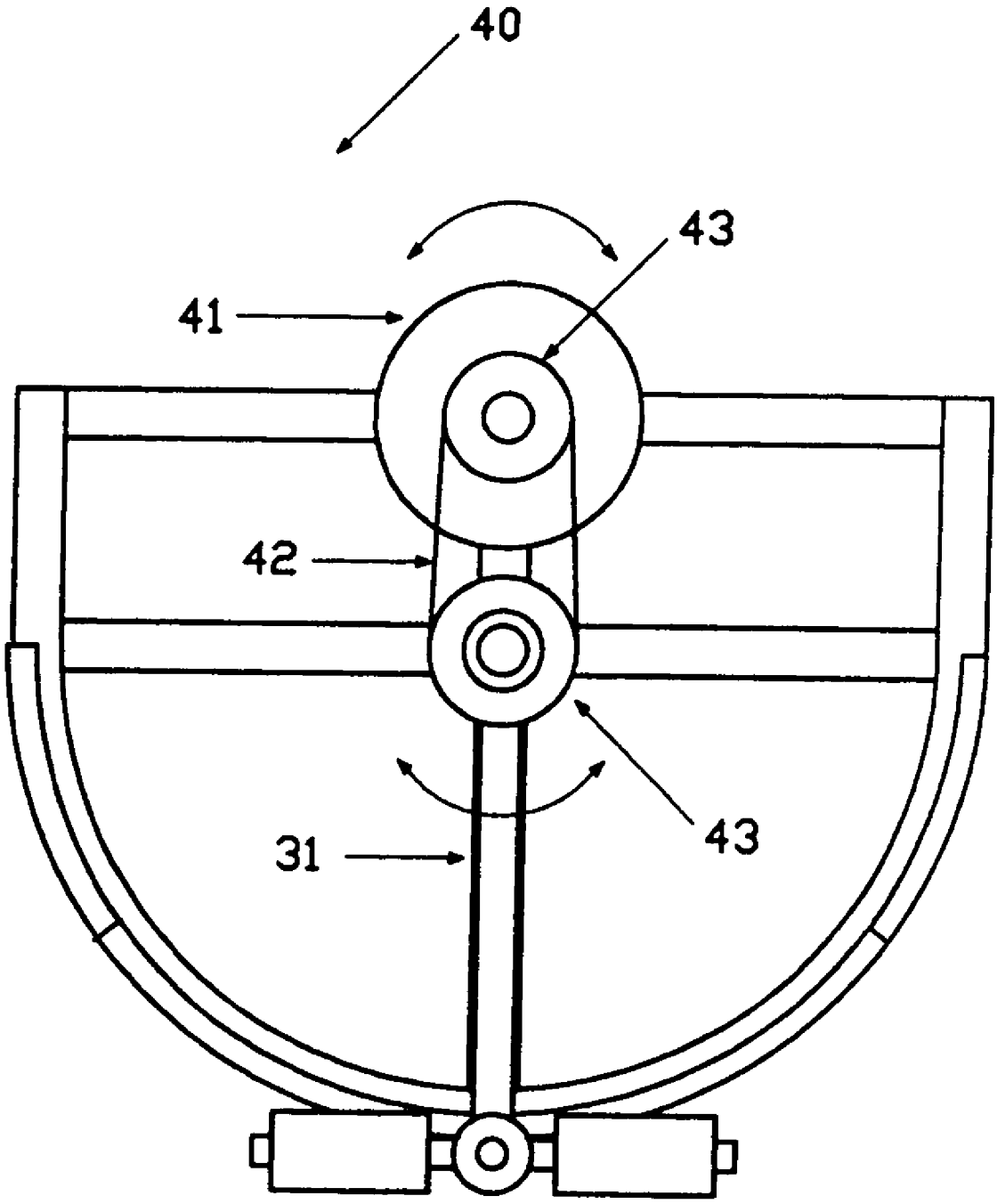
FIG. 6 is a top view of a resistance means which may be part of the variable exercise apparatus.

FIG. 6 demonstrates an optional resistance means 40 which may be part of the apparatus. The resistance means 40 may be a conventional type of resistance component, such as magnetic or electro-magnetic devices, which are very common in the fitness industry. It will connect to the user engagement means in a common manner, such as through a chain 42 and sprocket 43. Others methods of connection include a belt and pulley assembly, gear assembly, etc. In any case, the resistance means 40 will provide a resistance to the turning of the user engagement means about the support member of the frame structure. The resistance will also be applied to the upward and downward movement of the engaging support member. This depends upon the position of the wheel member with respect to the possible varying contours of the guide member. A protective cover, may be included for covering the assembly which connects the user engagement means and the resistance component. This may be utilized to keep objects from interfering with the operation of the assembly.

Figure 7:
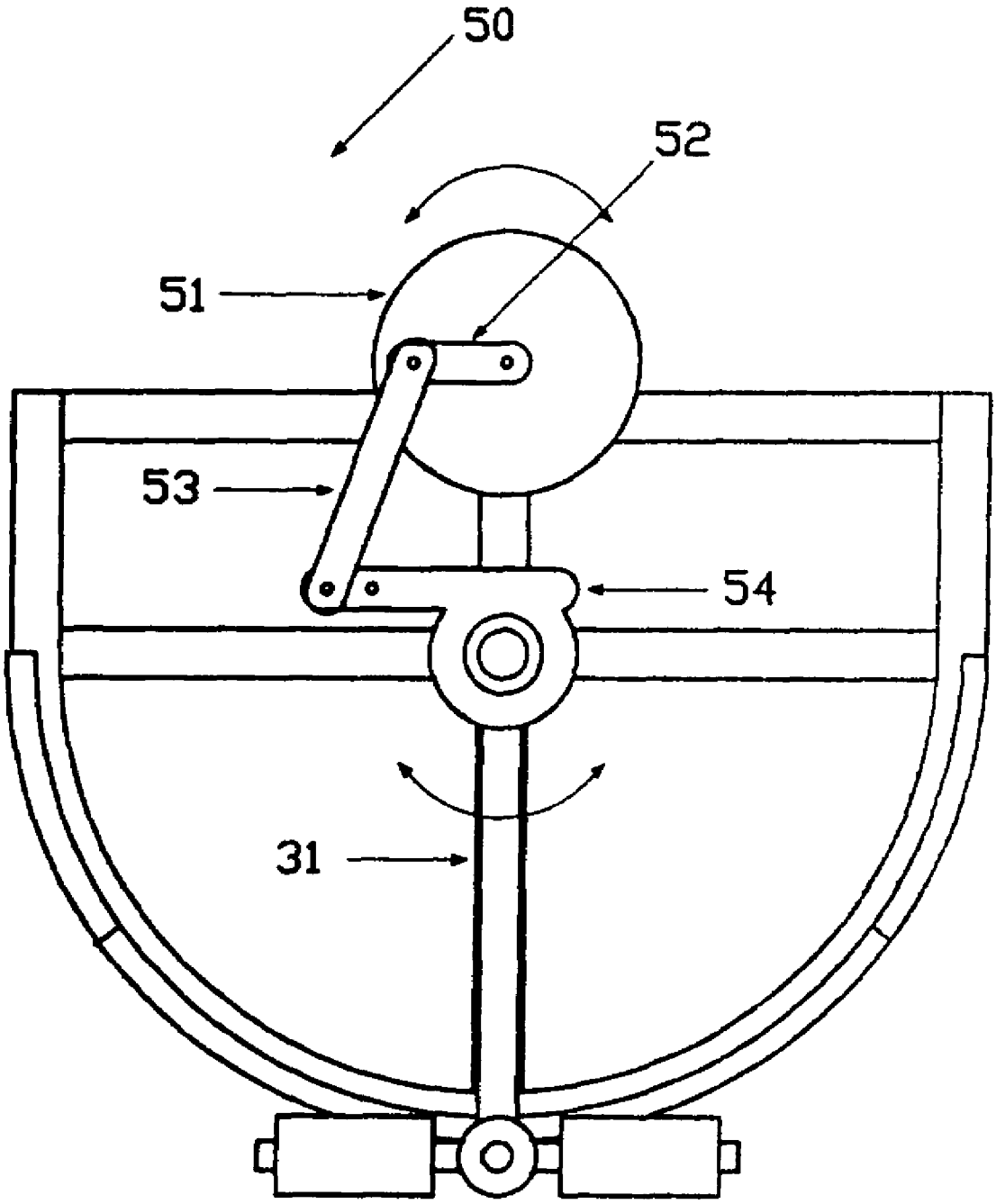
FIG. 7 is a top view of a motor means which may be part of the variable exercise apparatus.

FIG. 7 demonstrates an optional motor means 50 which may also be part of the apparatus. The motor means may consist of a motor 51 having a crank member 52 rigidly mounted to its shaft. The user engagement means may have a rocker member 54 rigidly mounted to it. A coupler member 53 may be used to connect the crank member 52 and the rocker member 54, with the points of connection being pivotable. Thus, as the motor shaft rotates in a circular motion, the crank member 52 will rotate accordingly, causing the rocker member 54 to rock back and forth. This is a conventional type of rocker-crank mechanism very common in the industry. Therefore circular rotation of the motor shaft will produce back and forth rotation of the user engagement means about frame structure means, and upward and downward movement of the assembly support member. The degree at which the user engagement means will turn back and forth may be adjusted by connecting the coupler member 53 to the rocker member 54 at different points along its length. A protective cover may be included for covering the linkage assembly which connects the user engagement means and the motor. This may be utilized to keep objects from interfering with the operation of the assembly.

Figure 8:
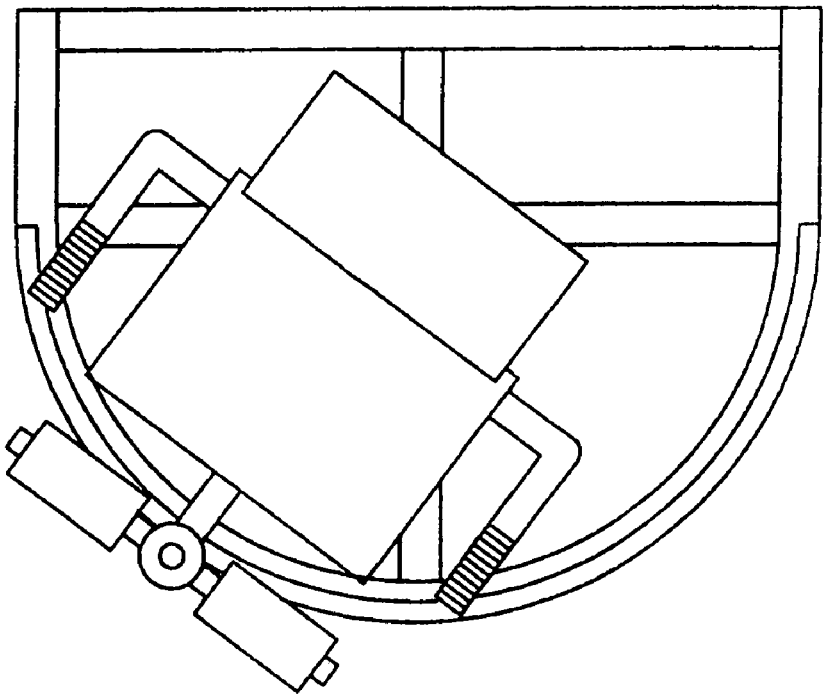
FIG. 8 is a top view of the variable exercise apparatus demonstrating an adjustable user support means.
Figure 9:
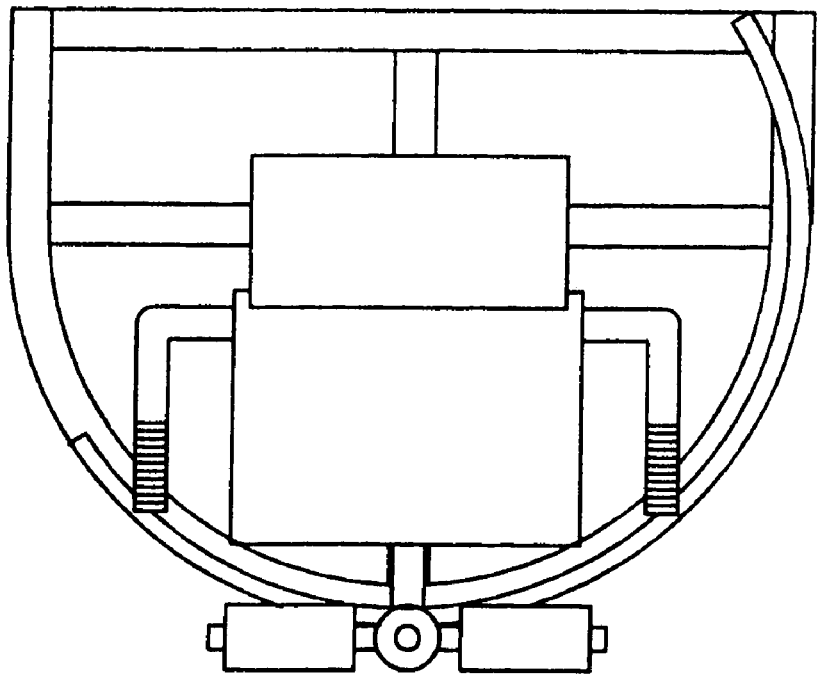
FIG. 9 is a top view of the variable exercise apparatus demonstrating an adjustable guide member.

The user may also be able to configure the apparatus for a desired exercise motion, concentrating on specific lower body muscle groups. As shown previously, the guide member mounted to the frame structure means may have different contours at different intervals. As example, one interval of the guide member may have a "U" or "V" shaped contour, another interval may have an inverted "U" or "V" shaped contour, while still another interval may have a flat contour. The user may position and secure the user support structure to the support member of the frame structure means at the desired interval, as shown in FIG. 8, so that the desired contour is positioned in front of the seat. The user support structure may be secured through a securing means, such as a bolt or pin. The user would pivot the user engagement means back and forth along that particular interval, thus concentrating on those lower body muscles groups required to perform this routine. Alternately, the user support structure could remain where it normally is, and the guide member positioned and secured at the desired interval, as shown in FIG. 9, so that the desired contour is in front of the user support structure. Again, the guide member may be secured to the base of the frame structure means through some type of securing means, such as a bolt or pin. This would have the same effect as moving and securing the user support structure at different intervals.

Many variations of the variable exercise apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A variable exercise apparatus comprising:

a frame structure member having a guide member mounted thereon, said guide member having a varying contour, a user support member mounted on said frame structure member, said user support member including a seat, a user engagement member comprising an engagement support structure extending in the forward and backward directions, said engagement support structure pivotally mounted at a backward end to said frame structure member such that said engagement support structure pivots in the generally horizontal plane, an assembly support member coupled to the forward end of said engagement support structure, said assembly support member movable in the general upward and downward directions, with the upper end of said assembly support member having an engagement assembly mounted thereon, and a coupling member for coupling the lower end of said assembly support member to said guide member of said frame structure member, a base, said guide member mounted to said base, a support member mounted to said base and extending in the general upward direction, said user support member being mounted to said support member, whereby a user may sit on the seat of the user support member and engage the engagement assembly with the general thigh portion of the leg such that the pivoting movement of the engagement support structure around the support member of the frame structure member produces movement of the assembly support member along the contour of the guide member which produces an upward and downward movement of the engagement assembly.

2. A variable exercise apparatus as claimed in claim 1, said user support member further comprising a seat support structure, said seat mounted on said seat support structure, said seat support structure mounted to said support member of said frame structure member; and a back support member and handle members mounted to said seat support structure.

3. A variable exercise apparatus according to claim 1 wherein said coupling member is a wheel member is mounted to the lower end of said assembly support member for coupling said assembly support member to said guide member of said frame structure member.

4. A variable exercise apparatus according to claim 1 further comprising a resistance member, said resistance member provides resistance to said upward and downward movement of said assembly support member.

5. A variable exercise apparatus as claimed in claim 1 further comprising a motor member operatively connected to said user engagement member for providing automatic rotation of said engagement support structure around said support member of said frame structure member, and also provide automatic upward and downward movement of said assembly support member.

6. A variable exercise apparatus as claimed in claim 2, said seat support structure being positionable and securable at different locations around said support member of said frame structure member.

7. A variable exercise apparatus as claimed in claim 1, said guide member being positionable and securable at different locations on said base of said frame structure means.

* * * * *